US008464895B2

(12) United States Patent
Gilbert et al.

(10) Patent No.: US 8,464,895 B2
(45) Date of Patent: Jun. 18, 2013

(54) BEVERAGE CONTAINER WITH ONE-HANDED OPERATION

(75) Inventors: Tyler Sean Gilbert, Bellevue, WA (US); Randy Sims, Franklin, TN (US)

(73) Assignee: Pacific Market International, LLC, Seattle, WA (US)

( * ) Notice: Subject to any disclaimer, the term of this patent is extended or adjusted under 35 U.S.C. 154(b) by 203 days.

(21) Appl. No.: 13/169,249

(22) Filed: Jun. 27, 2011

(65) Prior Publication Data

US 2012/0325815 A1 Dec. 27, 2012

(51) Int. Cl.

| | |
|---|---|
| ***A47G 19/22*** | (2006.01) |
| ***B65D 25/28*** | (2006.01) |
| ***B65D 51/04*** | (2006.01) |

(52) U.S. Cl.

USPC ..... 220/703; 220/715; 220/713; 220/714; 220/254.5; 220/254.9; 220/260; 220/255; 222/518; 222/506; 222/470; 222/43; 222/517; 215/387; 215/315; 215/311; 215/307

(58) Field of Classification Search

CPC ..... A47G 19/22; B65D 25/28; B65D 51/18

USPC ..... 220/254.5, 713, 714, 715, 212.5, 220/719, 264, 711, 368, 367.1, 283, 282, 220/281, 260, 326, 324, 661, 676, 745; 215/387, 315, 311, 307; 222/470, 43, 44, 222/518, 506, 559; 251/107, 109

See application file for complete search history.

(56) References Cited

U.S. PATENT DOCUMENTS

| | | | | |
|---|---|---|---|---|
| 118,860 | A * | 9/1871 | Kent | 222/509 |
| 404,192 | A * | 5/1889 | Haas | 222/509 |
| 421,282 | A * | 2/1890 | Jackson | 222/470 |
| 599,389 | A * | 2/1898 | Jackson | 222/470 |
| 656,000 | A * | 8/1900 | Wall | 222/487 |

(Continued)

FOREIGN PATENT DOCUMENTS

| | | |
|---|---|---|
| DE | 3402894 | 8/1985 |
| DE | 20003371 | 4/2000 |

(Continued)

OTHER PUBLICATIONS

U.S. Appl. No. 13/311,373, filed Dec. 5, 2011, George.

(Continued)

*Primary Examiner* — Mickey Yu
*Assistant Examiner* — Gideon Weinerth
(74) *Attorney, Agent, or Firm* — Davis Wright Tremaine LLP; George C. Rondeau, Jr.; Bobby B. Soltani

(57) ABSTRACT

A drinking vessel and lid assembly that is adapted for selectively opening an open end of the drinking vessel. The lid is selectively couplable to the drinking vessel and includes a selectively openable stopper that when closed, creates a fluid-tight seal between the drinking vessel and the environment. The stopper may be selectively opened by a user by the user pressing a button disposed on a side of the drinking vessel at a location where a user normally grasps the drinking vessel. The stopper is subsequently automatically closed when the user releases the button. Thus, a user may open and close the stopper using a single hand operation without the need to remove the lid from the drinking vessel.

26 Claims, 7 Drawing Sheets

U.S. PATENT DOCUMENTS

| | | | | | |
|---|---|---|---|---|---|
| 657,636 | A | * | 9/1900 | Bingham | 222/487 |
| 768,355 | A | * | 8/1904 | Bolen | 222/508 |
| 2,210,206 | A | * | 8/1940 | Fisher | 401/206 |
| 2,274,849 | A | * | 3/1942 | Peterson | 222/470 |
| 2,447,870 | A | | 8/1948 | Polcyn | |
| 2,884,157 | A | * | 4/1959 | Lampkin | 220/348 |
| 3,059,816 | A | | 10/1962 | Goldstein | |
| 3,739,938 | A | | 6/1973 | Paz | |
| 3,964,631 | A | | 6/1976 | Albert | |
| 3,967,748 | A | | 7/1976 | Albert | |
| 3,972,443 | A | | 8/1976 | Albert | |
| 4,094,433 | A | | 6/1978 | Numbers | |
| 4,099,642 | A | * | 7/1978 | Nergard | 220/715 |
| 4,136,799 | A | | 1/1979 | Albert | |
| 4,212,408 | A | * | 7/1980 | Valenzona | 220/254.5 |
| 4,276,992 | A | * | 7/1981 | Susich | 220/254.5 |
| 4,303,173 | A | * | 12/1981 | Nergard | 220/254.5 |
| 4,676,411 | A | | 6/1987 | Simasaki | |
| 4,834,270 | A | * | 5/1989 | Messner | 222/484 |
| 5,427,271 | A | | 6/1995 | Wang | |
| 5,485,938 | A | | 1/1996 | Boersma | |
| 5,495,966 | A | | 3/1996 | Won | |
| 5,615,808 | A | | 4/1997 | Huang | |
| 5,918,854 | A | * | 7/1999 | Barrash et al. | 251/116 |
| 5,944,235 | A | * | 8/1999 | Won | 222/506 |
| 6,098,834 | A | | 8/2000 | Hatsumoto et al. | |
| 6,116,476 | A | | 9/2000 | Huang | |
| 6,626,314 | B1 | | 9/2003 | McHenry et al. | |
| 6,763,964 | B1 | | 7/2004 | Hurlbut et al. | |
| 7,413,096 | B2 | * | 8/2008 | Morgan et al. | 220/254.9 |
| 7,546,933 | B2 | | 6/2009 | Pinelli | |
| 7,997,442 | B2 | | 8/2011 | Pinelli | |
| 8,297,462 | B1 | * | 10/2012 | Joyce | 220/254.5 |
| 8,376,162 | B2 | * | 2/2013 | Yang | 215/244 |
| 2002/0033400 | A1 | * | 3/2002 | Rohrer et al. | 220/715 |
| 2004/0040962 | A1 | * | 3/2004 | Bielecki et al. | 220/254.1 |
| 2004/0217139 | A1 | * | 11/2004 | Roth et al. | 224/148.7 |
| 2005/0029265 | A1 | | 2/2005 | Morgan et al. | |
| 2006/0096983 | A1 | | 5/2006 | Patterson | |
| 2006/0175331 | A1 | * | 8/2006 | Lin et al. | 220/254.5 |
| 2006/0226160 | A1 | * | 10/2006 | Elsaden et al. | 220/715 |
| 2007/0210093 | A1 | | 9/2007 | Pinelli | |
| 2008/0156817 | A1 | | 7/2008 | Roseblade et al. | |
| 2008/0237233 | A1 | | 10/2008 | Choi et al. | |
| 2008/0272134 | A1 | | 11/2008 | Rohe | |
| 2011/0132908 | A1 | * | 6/2011 | Meehan | 220/254.3 |
| 2011/0309095 | A1 | | 12/2011 | Pinelli | |

FOREIGN PATENT DOCUMENTS

| | | |
|---|---|---|
| JP | 09-150852 | 6/1997 |
| JP | 2009-279332 | 12/2009 |
| KR | 20-1998-0061202 | 11/1998 |
| WO | 0034143 | 6/2000 |

OTHER PUBLICATIONS

U.S. Appl. No. 12/946,501, filed Nov. 15, 2010, Gilbert et al.
European search report for Application No. EP12173632 dated Oct. 18, 2012.

* cited by examiner

BEVERAGE CONTAINER WITH ONE-HANDED OPERATION

BACKGROUND OF THE INVENTION

1. Field of the Invention

The present invention is directed generally to beverage containers and more particularly to beverage containers having lids that are selectively openable and closable using only one hand.

2. Description of the Related Art

Prior art lids are typically of one of three types. The first type is a solid unitary lid that does not include openings or apertures through which the contents of a liquid storage vessel may exit the vessel. To drink from the vessel, a user must remove the lid. The second type, which may also be of a unitary construction, includes one or more unobstructed apertures through which the liquid may exit the vessel. In the second type, the apertures are always open. If the vessel is inadvertently tipped or dropped, the contents of the vessel may spill. The third type of lid includes one or more apertures through which the liquid may exit the vessel and a means for selectively opening and closing the apertures. When using the third type of lid, the user may selectively open the apertures to remove the contents from the vessel and selectively close the apertures to maintain the contents inside the vessel. Further, by closing the apertures, the lid may help insulate the contents from the environment outside the vessel.

DETAILED DESCRIPTION OF THE INVENTION

Figure 1:
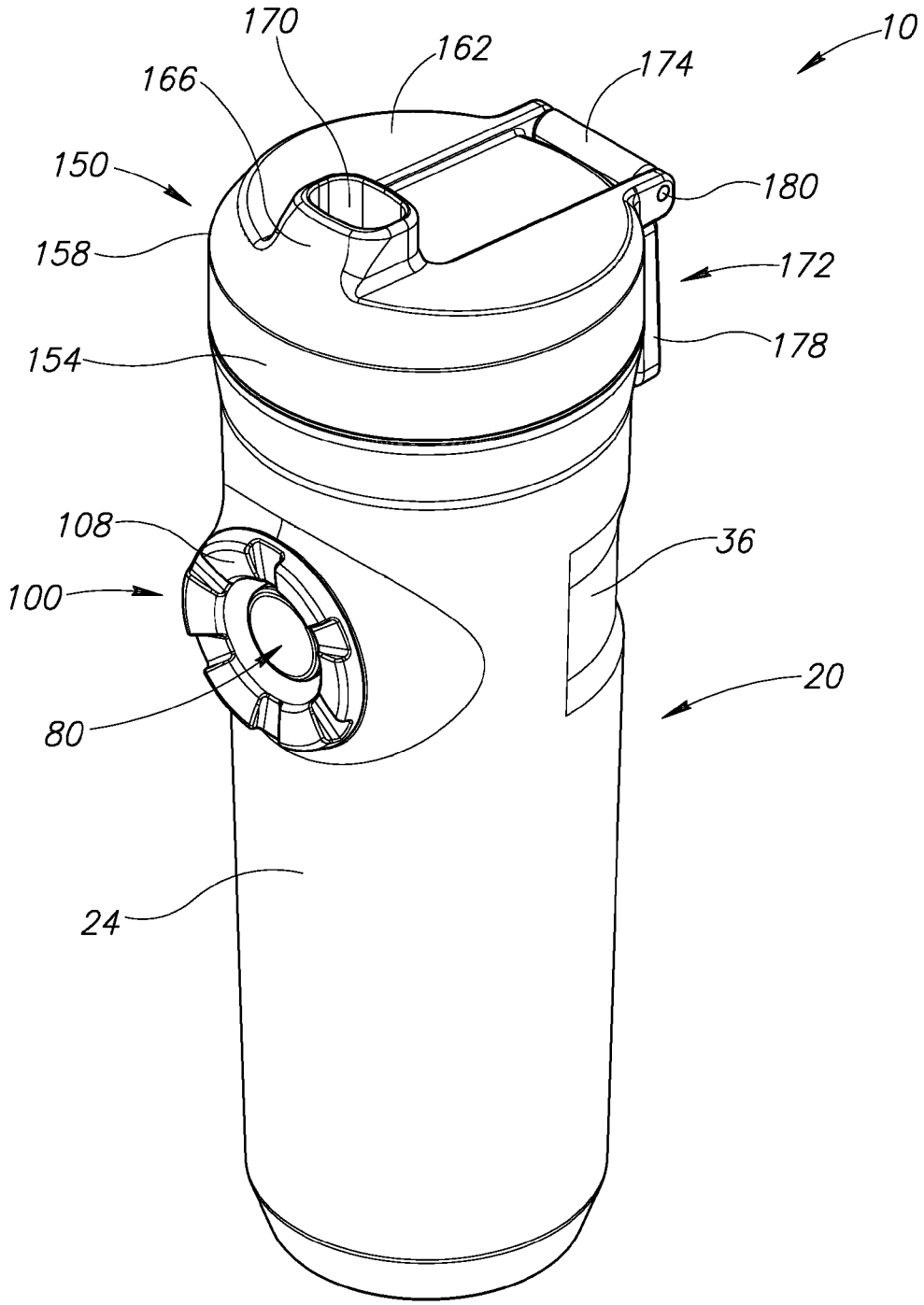
FIG. 1 is a top left side perspective view of a drinking vessel and lid assembly constructed in accordance with the present invention.

A drinking vessel and lid assembly, in accordance with an embodiment of the present invention, is generally indicated by reference numeral 10 in FIG. 1. The assembly 10 comprises a beverage container or drinking vessel 20 and a lid 150. The lid 150 has a generally cylindrical body 158 that is adapted for closing an open end 47 (see FIG. 2) of the drinking vessel 20 that leads into an interior cavity 48. The drinking vessel 20 may be any suitable type of container such as the tumbler type (that is, without a handle) for use in automotive beverage receptacles, or for transport in backpacks, book bags, bicycle bottle cages, and the like. The lid 150 is selectively couplable to the drinking vessel 20 by any suitable means, such as interior threads 156 (see FIGS. 3B and 4B) disposed on an inner surface of a lower, downwardly-depending portion 154 of the body 158. The threads 156 are configured to threadably engage with exterior threads 58 disposed on an upper portion 56 of the drinking vessel 20 (see FIG. 2). The particular configuration for mating the lid 150 to the drinking vessel 20 is a matter of choice for one of ordinary skill in the art. Thus, although threads 156 and 58 have been shown in this embodiment, those of ordinary skill in the art will appreciate that any other means for attaching and sealing the lid 150 with respect to the drinking vessel 20 may be substituted.

As best seen in FIG. 1, an upper portion 162 of the body 158 of the lid 150 also includes a raised spout portion 166 configured for contact with a user's lips when the entire assembly 10 is tipped toward the user, such that the user may drink a beverage from the drinking vessel 20 to which the lid 150 is attached. The spout portion 166 forms an aperture or opening 170 configured to permit fluid passage therethrough when a user drinks a beverage.

Figure 2:
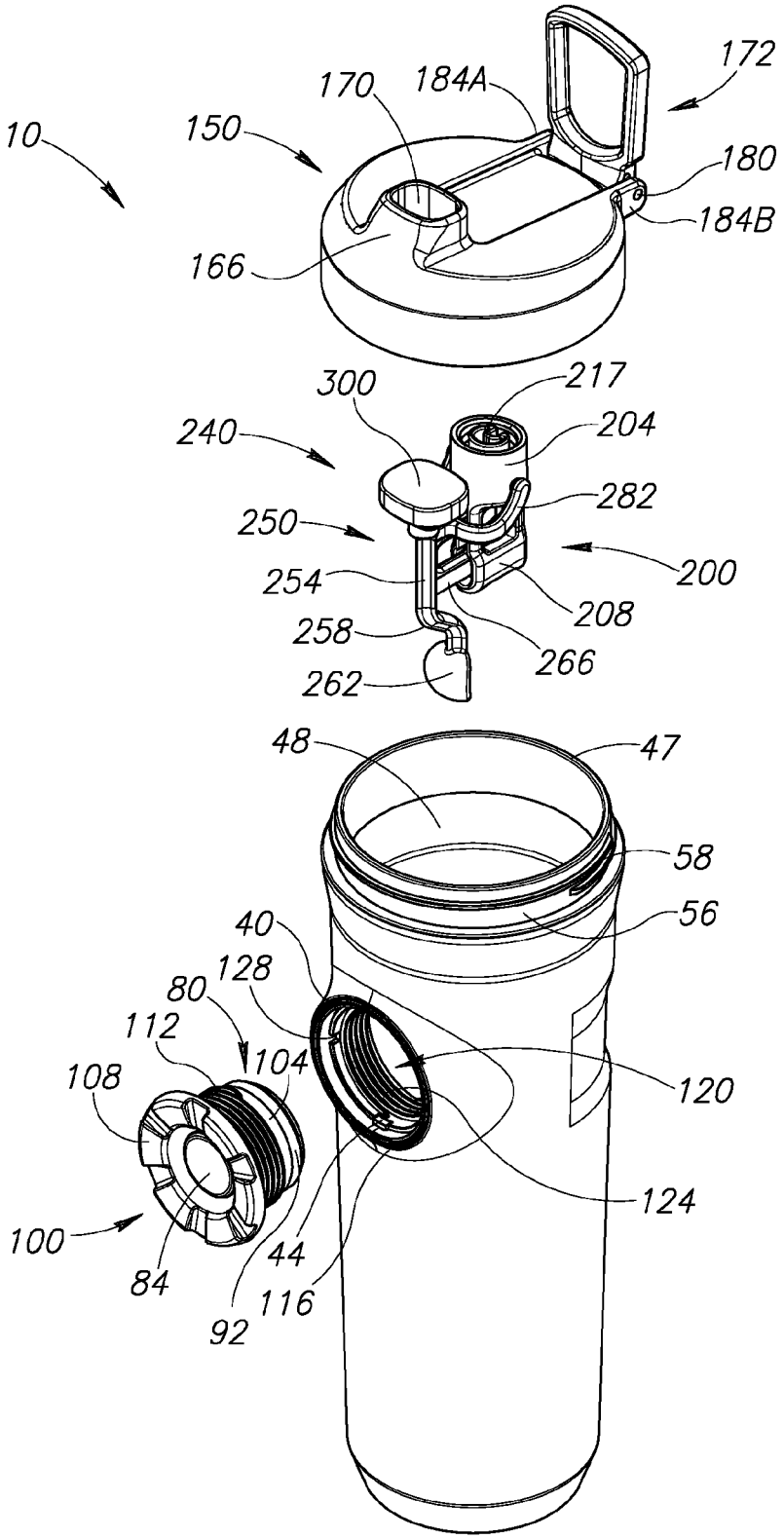
FIG. 2 is a partially exploded top perspective view of the drinking vessel and lid assembly of FIG. 1.
Figure 3A:
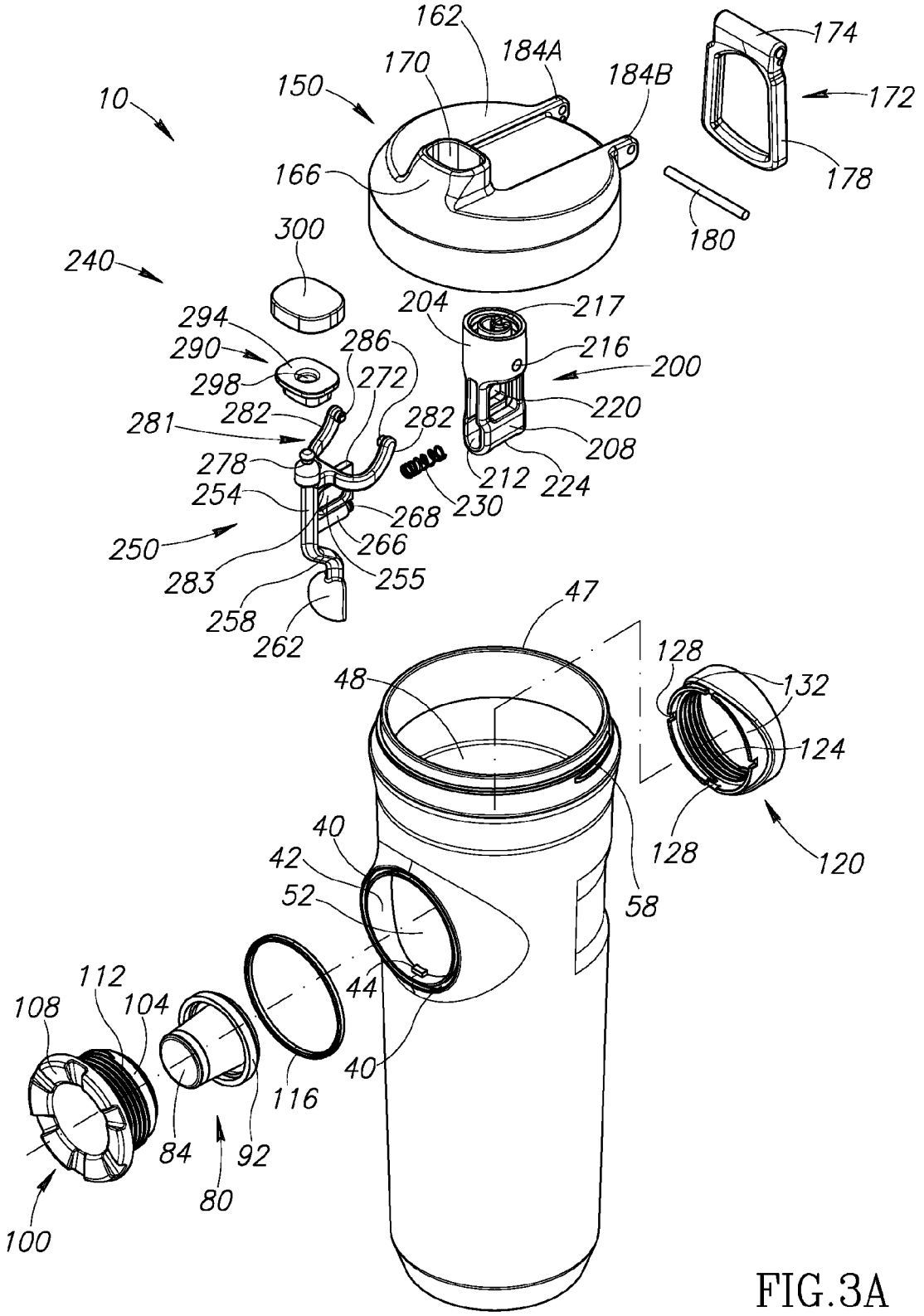
FIG. 3A is a more fully exploded top perspective view of the drinking vessel and lid assembly of FIG. 1.

As may best be viewed in FIG. 3A, the upper portion 162 further includes first and second hinge pin mounts 184A and 184B, respectively, that are configured to mount a finger loop 172 to allow a user to easily carry the assembly 10. The finger loop 172 includes a hinge pin sleeve 174, in which a hinge pin 180 is positioned, and a loop portion 178. The hinge pin 180 is coupled to the hinge pin mounts 184A and 184B such that the finger loop 172 is removably or fixedly secured to the lid 150. The finger loop 172 may be operative to rotate about the hinge pin 180 between a downward extending position shown in FIG. 1 to an upward extending position shown in FIG. 2. In other embodiments, the finger loop 172 may be operative to rotate over a larger or smaller range of angles (e.g., 90 degrees, 270 degrees, or the like). In operation, a user may carry the assembly 10 by inserting a finger or other object (e.g., a belt, a strap, or the like) into the loop portion 178 of the finger loop 172.

Figure 4A:
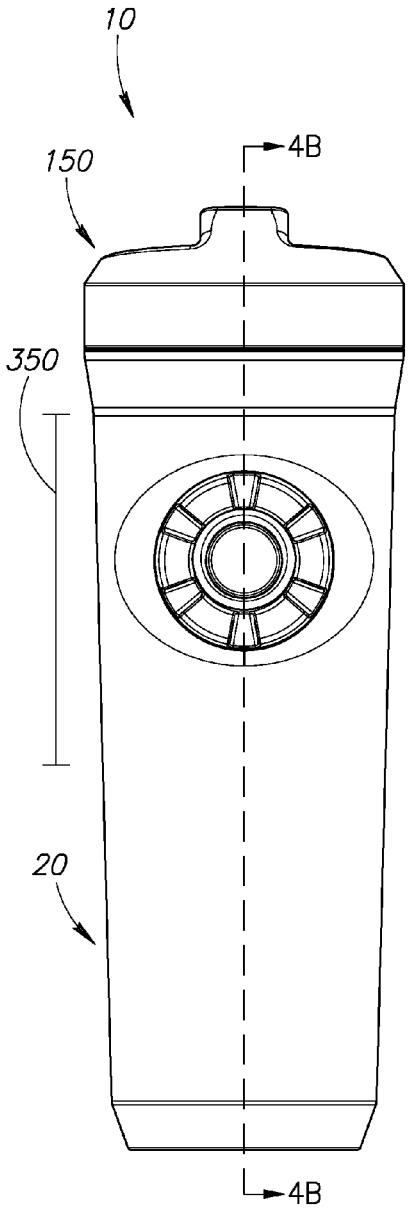
FIG. 4A is a front elevational view of the drinking vessel and lid assembly of FIG. 1 with a stopper in a closed position.
Figure 4B:
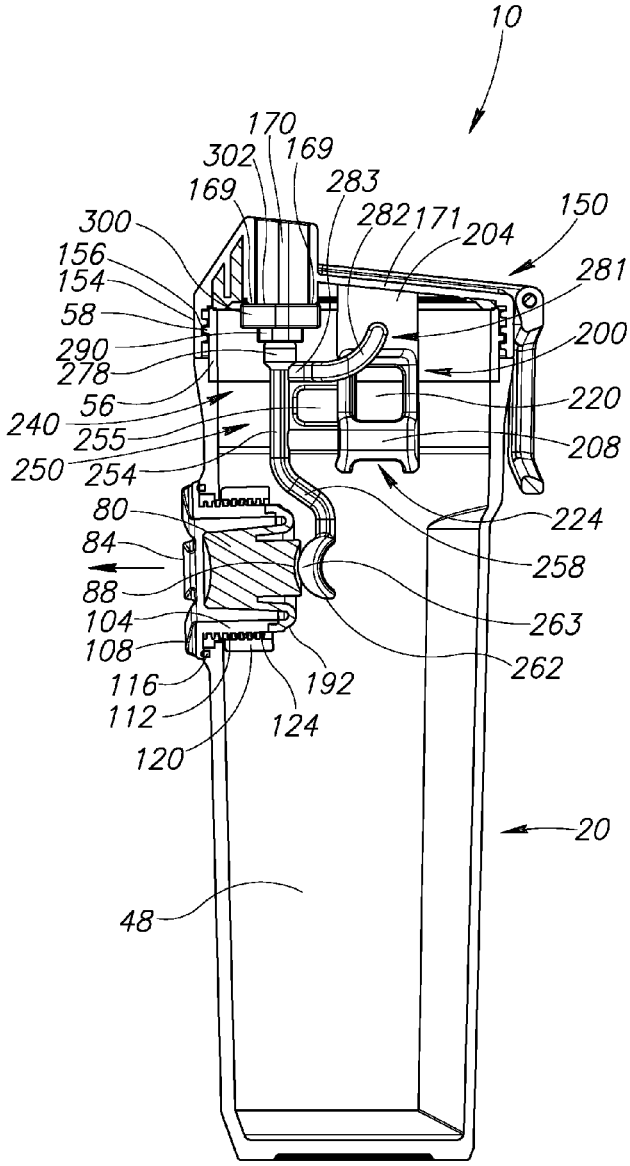
FIG. 4B is a partial cross-sectional view of the drinking vessel and lid assembly taken substantially along the line 4B-4B of FIG. 4A.

Fluid communication between the opening 170 of the lid 150 and the interior cavity 48 of the drinking vessel 20 is controlled by way of a selectively openable stopper assembly 240, which may best be viewed in FIGS. 2 and 4B. The stopper assembly 240 includes a stopper 290 having a raised platform 294 (see FIG. 3A) configured for attachment of a stopper seal 300 to an upper side thereof. The stopper seal 300 may be formed from a flexible material such as rubber and is shaped to be securely positioned over the raised platform 294 of the stopper 290. The stopper 290 also includes a socket portion 298 configured for movable attachment to a ball joint 278 as described below.

The stopper assembly 240 further includes an arm 250 having an upper portion 254 and a lower, curved portion 258. The upper portion 254 is coupled to the ball joint 278 which is in turn coupled to the stopper 290. The lower portion 258 is coupled to a bowl-shaped portion 262 having a laterally outward projecting convex-shaped actuating member contact surface 263 (see FIG. 4B) for contacting an actuating member coupled to the drinking vessel 20, as discussed below. As may best be viewed in FIGS. 3A and 4B, the arm 250 also includes a wishbone shaped member 281 having two spaced-apart forked members 282 that are rigidly coupled to the upper portion 254 via a stem member 283 and each include inward facing cylindrical protrusions or pegs 286 that permit pivotal attachment of the arm 250 to a biasing member housing 200 (or other fixed, downwardly extending member or portion). The arm 250 also includes a laterally-extending spring coupling portion 266 having a threaded distal end 268 for threaded engagement with a stopper biasing member 230 (in the illustrated embodiment, a spring). The arm 250 further includes a laterally extending guide portion 272 that defines an opening 255 for allowing liquid to pass therethrough for easy washing.

Figure 6A:
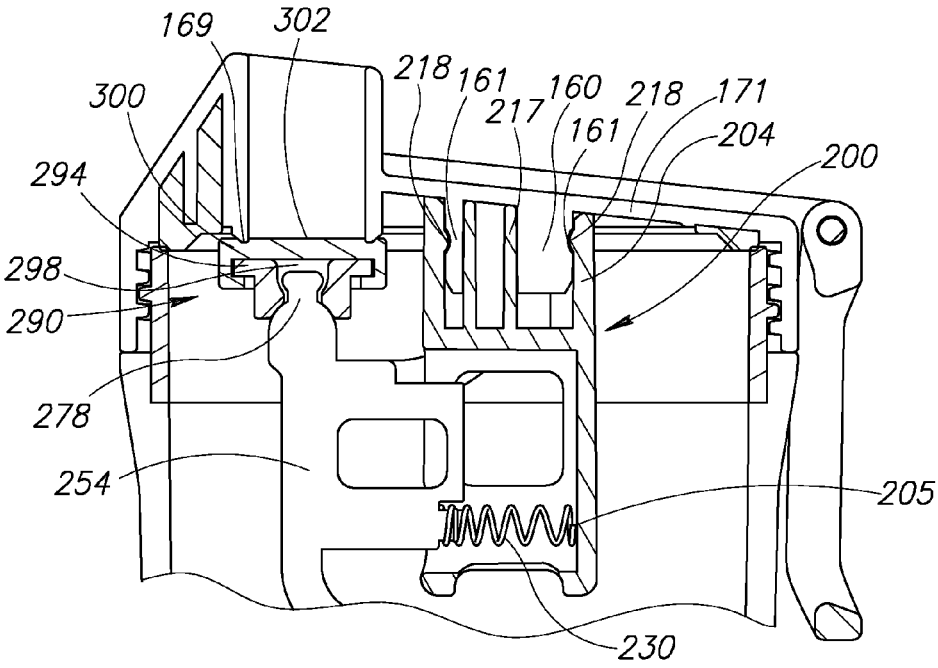
FIG. 6A is an enlarged partial cross-sectional view of the drinking vessel and lid assembly taken along the line 4B-4B of FIG. 4A.
Figure 6B:
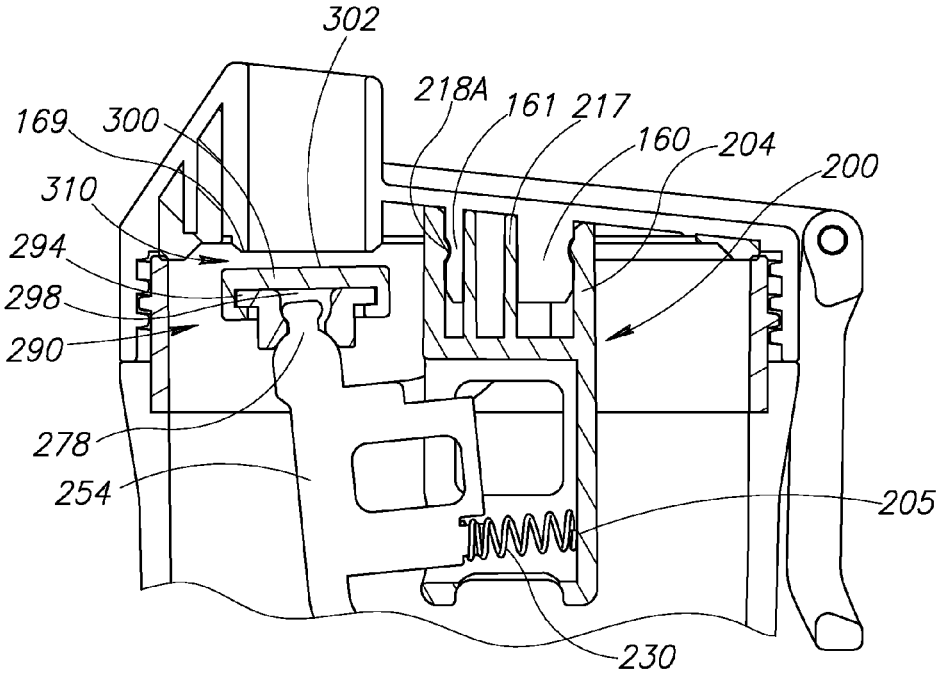
FIG. 6B is an enlarged partial cross-sectional view of the drinking vessel and lid assembly taken along the line 5B-5B of FIG. 5A.

The stopper assembly 240 also includes a stopper biasing member housing or spring housing 200, which is fixedly or removably attached to the lid 150. The spring housing 200 includes an upper portion 204 comprising two spaced-apart apertures or openings 216 configured to receive the inward facing pegs 286 of the forked members 282 of the arm 250, so that the arm may be pivotally coupled to the spring housing. The upper portion 204 also includes a keyed lid coupling portion 217 configured to couple the spring housing 200 with a post 160 that extends downward from a bottom surface 171 of the lid 150 (see FIGS. 3B, 6A, and 6B). As best shown in FIGS. 6A and 6B, the upper portion 204 includes a inward-facing circumferential ridge 218 for engagement (e.g., a snap fit) with a corresponding groove 161 of the post 160.

The spring housing 200 also includes a lower portion 208 defining an opening or slot 212 for receiving the spring 230, part of the spring coupling portion 266, and part of the guide portion 272. The lower portion 208 also includes pass-through openings 220 and a downward facing opening 224 to permit liquid to pass through the spring housing 200 (e.g., so that the housing 200 may be easily washed).

Figure 3B:
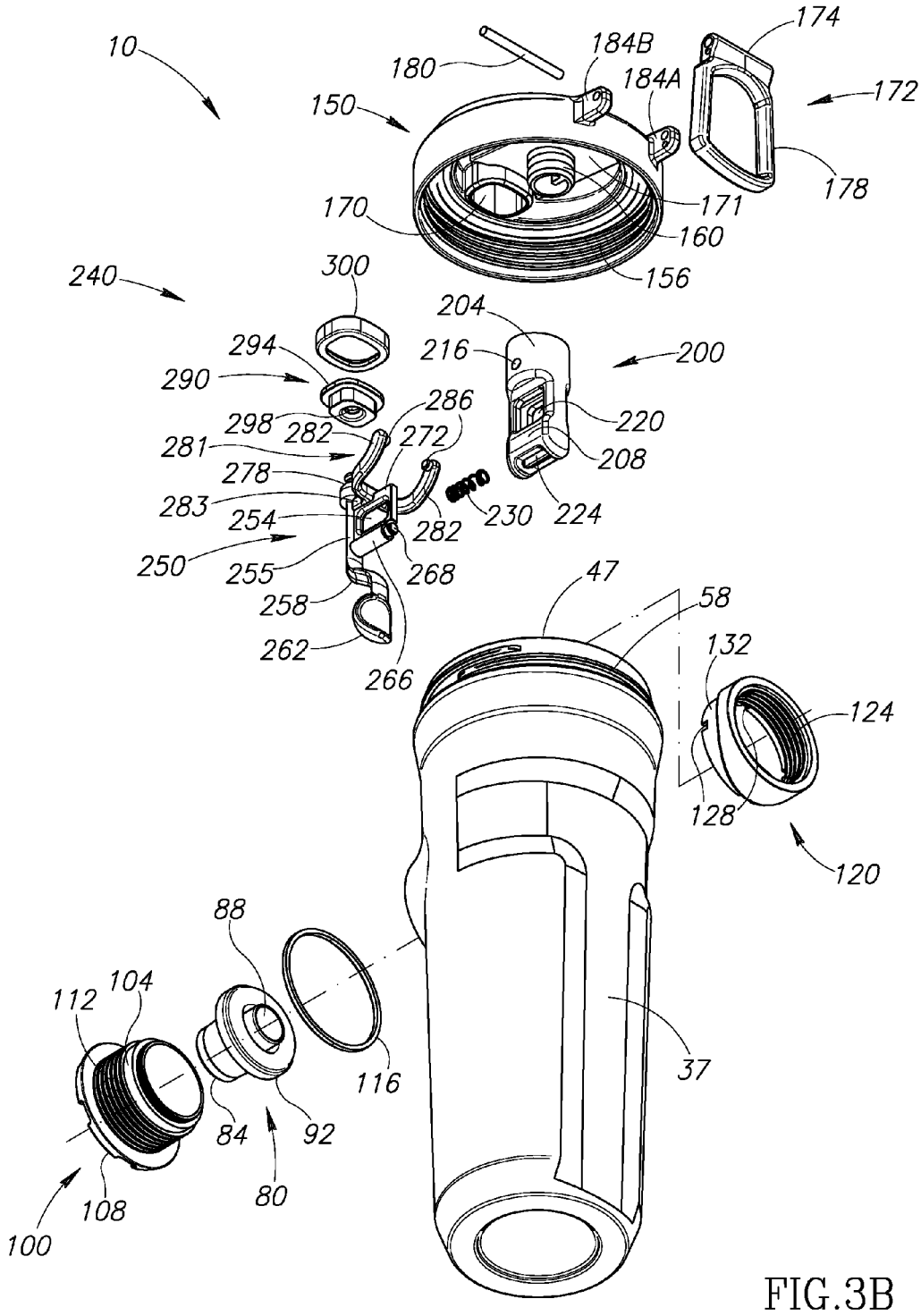
FIG. 3B is an exploded bottom perspective view of the drinking vessel and lid assembly of FIG. 1.

As shown in FIG. 1, the assembly 10 further includes an actuating assembly 100 comprising an actuating member or button 80 disposed within an outer ring 108. The actuating assembly 100 is located at the front of the outer surface 24 of the drinking vessel 20 where a user may normally place his or her thumb when grasping the drinking vessel 20 to take a drink therefrom. That is, the actuating assembly 100 is vertically aligned with the raised spout portion 166 when the lid 150 is coupled to the drinking vessel 20. The actuating assembly 100 is also opposite a recessed grip surface 36 of the drinking vessel 20. As shown in FIG. 4A, the portion of the drinking vessel 20 where a user normally grasps it during use may be referred to as a grip region or grip zone 350. As shown in FIG. 3B, in this embodiment the drinking vessel 20 also includes a substantially flat surface 37 extending downward from the grip surface 36 to the bottom of the drinking vessel. The grip surface 36 and the flat surface 37 may permit the drinking vessel 20 to be easily inserted into a device for carrying or holding drinking vessels, such as a conventional water bottle cage that is fixed to a bicycle.

An exploded view of the components of the actuating assembly 100 is illustrated in FIGS. 3A and 3B. As shown in FIGS. 2 and 3A, the button 80 may include a thin rim portion 92 that is fixedly coupled (see FIG. 3A) to an end portion of a cylindrical wall 104 of the outer ring 108. The button 80 also includes a user contact surface 84 and an inwardly located concave-shaped contact surface 88 (see FIG. 3B) positioned opposite the user contact surface. The actuating assembly 100 also includes a securing member or collar 120 that includes interior threads 124 configured for threaded engagement with exterior threads 112 disposed on the wall 104 of the outer ring 108.

As shown in FIGS. 2 and 3A, the collar 120 includes one or more notches 128 that correspond to raised portions or keys 44 disposed on a circumferential surface or wall 42 in the drinking vessel 20 that defines an opening 52. In operation, a user may insert the collar 120 into the cavity 48 of the drinking vessel 20 from within the drinking vessel and place the collar in the opening 52 so that the keys 44 are positioned within the notches 128. As shown in FIG. 3A, the collar 120 includes lateral recessed portions 132 shaped to coincide with the shape of the inner wall 42 of the drinking vessel 20 so that the collar fits securely within the opening 52.

Once the collar 120 is in place as shown in FIG. 2, the outer ring 108 may be coupled to the collar 120 (and to the drinking vessel 20) from outside the drinking vessel by threadably engaging the exterior threads 112 of the outer ring with the interior threads 124 of the collar. As shown in FIGS. 2 and 4B, a flexible seal member 116 (e.g., a ring seal) may be removably or fixedly positioned within a seal groove 40 disposed on the outer wall 24 of the drinking vessel 20 around the opening 52 to form a liquid-tight seal between the outer ring 108 and the interior cavity 48 of the drinking vessel 20.

Figure 5A:
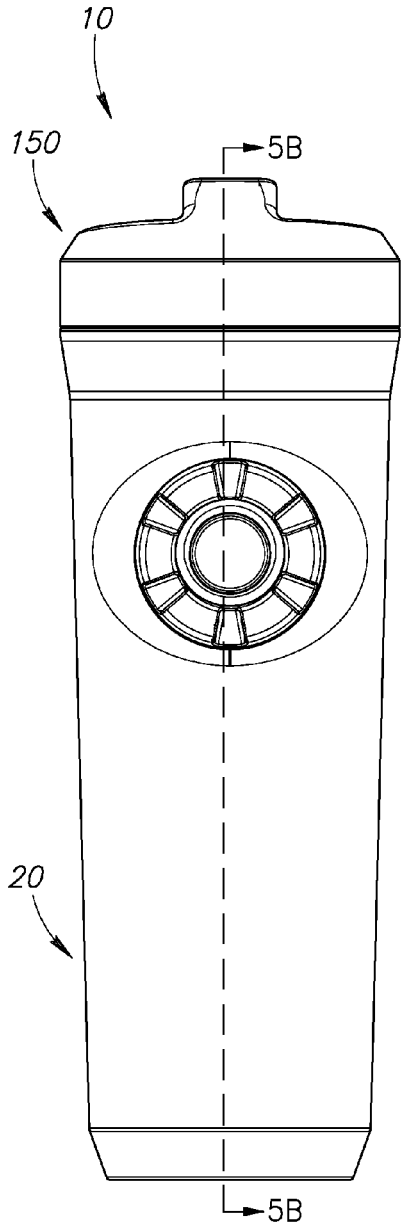
FIG. 5A is a front elevational view of the drinking vessel and lid assembly of FIG. 1 with the stopper in an opened position.
Figure 5B:
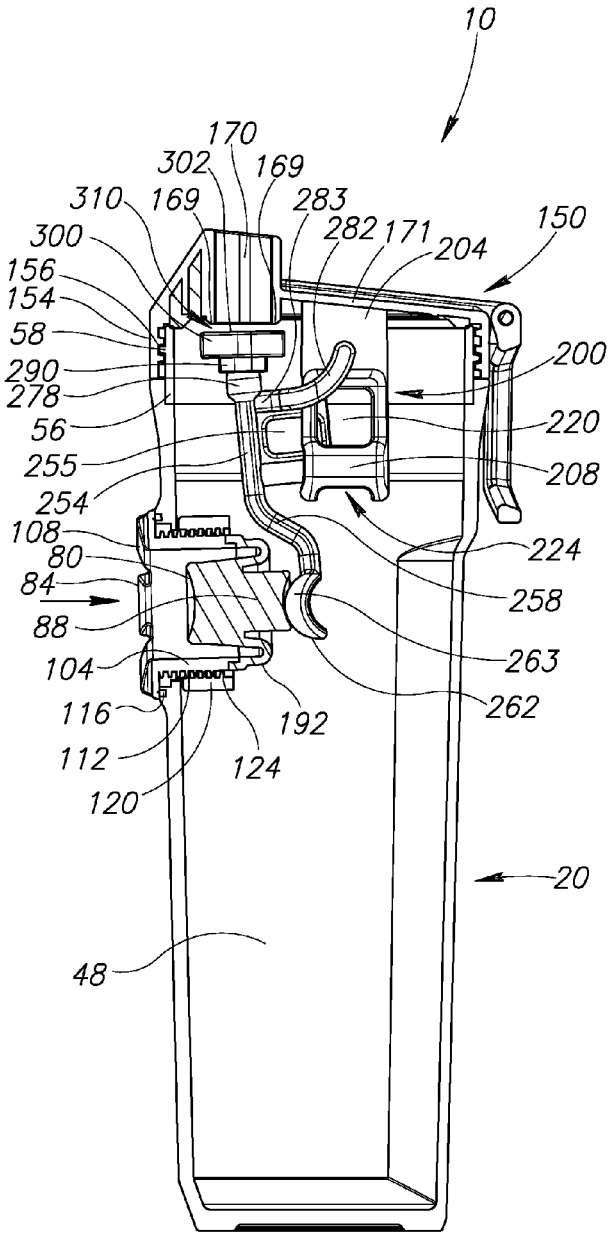
FIG. 5B is a partial cross-sectional view of the drinking vessel and lid assembly taken substantially along the line 5B-5B of FIG. 5A.

The operation of the stopper assembly 240 is now described with reference to FIGS. 4B, 5B, 6A, and 6B, which show various cut-away left side elevational views of the assembly 10 when the stopper 290 is in a sealed or closed position (FIGS. 4B and 6A) and an opened position (FIGS. 5B and 6B). As shown in FIG. 6A, movement of the spring 230 is restricted by its engagement with an inner wall 205 of the spring housing 200, which causes the spring 230 to bias the arm 250 of the stopper assembly 240 away from the inner wall 205. That is, the spring 230 biases the arm 250 for rotational movement in a clockwise direction (as shown in FIGS. 4B, 5B, 6A, and 6B), so that the stopper seal 300 is pressed upward against a downward facing stopper seal contact surface 169 of the lid 150, thereby sealing the interior cavity 48 of the drinking vessel 20 from the opening 170 of the lid. As can be appreciated, the spring 230 should be operative to provide sufficient force on the arm 250 to provide a fluid-tight seal between the stopper seal 300 and the downward facing surface 169 of the lid 150.

As shown in FIG. 4B, the convex contact surface 263 of the bowl-shaped portion 262 of the arm 250 is substantially adjacent to the concave surface 88 of the button 80. In some embodiments, the surfaces 88 and 263 may be slightly spaced apart from each other. The surfaces 88 and 263 are shaped to coordinate with each other such that, when a user removes the lid 150 by rotating it (which also rotates the arm 250) relative to the drinking vessel 20, the bowl-shaped portion 262 does not contact the button 80 as it rotates. In the illustrated embodiment, the surfaces 88 and 263 have laterally extending recesses or grooves.

In operation, a user may press on the user contact surface 84 of the button 80 to move the stopper assembly 240 into the opened position wherein the stopper seal 300 is spaced apart (as indicated by a space 310 in FIGS. 5B and 6B) from the downward facing seal contact surface 169 of the lid 150. As can be appreciated, when the stopper assembly 240 is in the opened position, liquid can flow freely from the interior cavity 48 of the drinking vessel 20 through the opening 170 in the lid 150.

As shown in FIGS. 5B and 6B, when moving the stopper into the opened position, a user presses on the user contact surface 84 of the button 80, the button moves radially inward and the inner contact surface 88 of the button contacts and exerts a radially inward force on the arm 250 at the actuating member contact surface 263. This force overcomes the bias of the spring 230 and causes the stopper assembly 240 to rotate or pivot (counterclockwise as depicted in FIGS. 5B and 6B) about the pegs 286 disposed on the ends of the forked members 282, creating the space 310 between the stopper seal 300 and the contact surface 169 of the lid 150. As the stopper assembly 240 is moved between the closed position and the opened position, a portion of the spring coupling portion 266 and the guide portion 272 of the arm 250 move into the opening 212 in the lower portion 204 of the spring housing 200. The opening 212 and the guide portion 272 are sized and shaped to be guided by the opening 212 so as to maintain alignment of the arm 250 as the stopper assembly 240 moves between the opened position and the closed position.

In the illustrated embodiment, the thin rim portion 92 of the button 80, which is fixedly attached to the wall 104 of the outer ring 108, is formed of a flexible material (e.g., rubber) that elastically stretches or deforms when a user presses on the button, allowing the button to move radially inward. When a user releases the button 80, the rim portion 92 of the button 80 returns to its default shape, causing the button 80 to automatically move radially outward to the position shown in FIGS. 4B and 6A. Since the spring 230 biases the stopper assembly 240 into the closed position, the stopper assembly is automatically moved from the opened position to the closed position when a user releases the button 80. Further, as discussed above, the stopper 290 is coupled to the arm 250 by the socket 298 and the ball joint 278. The socket 298 and the ball joint 278 are sized so that the stopper 290 is free to tilt a few degrees (e.g., 5 to 15 degrees, or the like) relative to the arm 250 so that the stopper seal 300 uniformly presses against the downward facing contact surface 169 of the lid 150 when in the closed position, thereby creating a fluid-tight seal.

As can be appreciated, the assembly 10 described above may be disassembled by a user for cleaning when desired. As may best be viewed in FIG. 2, a user may simply unscrew the lid 150 from the drinking vessel 20. In some embodiments, the user may be able to separate the spring housing 200 from the lid 150, or to separate the arm 250 from the spring housing. As described above, the user may also be able to remove the actuating assembly 100 from the drinking vessel 20 by rotating the outer ring 108 relative to the collar 120, and removing the collar 120 after the outer ring 108 is separated. Once these components have been cleaned, the user may then reassemble the assembly 10 for further use.

Using the assembly 10 of the present invention, a user may open and drink from the drinking vessel 20 to which the lid 150 is attached using the same one hand used to grip the drinking vessel by simply pressing the button 80 radially inward with a finger (e.g., a thumb) of that same hand while consuming a beverage and releasing the button thereafter to automatically reseal the drinking vessel. The button 80 is conveniently positioned within the grip zone 350 of the drinking vessel 20 so that the user can easily open and close the assembly 10 without changing his or her grip on the drinking vessel 20 and without substantially modifying the way he or she normally grasps the drinking vessel 20 when drinking therefrom. As can be appreciated, the ability to open, drink from, and close a container using only one hand may be desirable for various active users including bicyclists, hikers, drivers, and others desiring to use a single hand and keep the other hand free when operating a drinking vessel.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A drinking vessel and lid assembly, comprising:

a drinking vessel comprising a sidewall portion having a sidewall opening therein;

an actuating member extending into the sidewall opening and being movably coupled to the drinking vessel, the actuating member being movable inward and outward and comprising a first contact surface positioned inside the drinking vessel; and a lid comprising:

a body selectively couplable to the drinking vessel, the body including an upper portion having a drinking opening configured to selectively permit fluid passage therethrough when the lid is coupled to the drinking vessel; and a stopper pivotably coupled to the body and configured for upward displacement into a closed position wherein the stopper engages a portion of the body and covers the drinking opening to prevent fluid passage therethrough, and downward displacement into an opened position wherein the stopper is spaced apart from the portion of the body to allow fluid passage through the drinking opening, the stopper having a downwardly extending arm portion having a second contact surface that is positioned inside the drinking vessel and is substantially adjacent to the first contact surface of the actuating member when the lid is coupled to the drinking vessel;

the first contact surface of the actuating member and the second contact surface of the stopper being positioned for the first contact surface to engage the second contact surface in response to inward movement of the actuating member and thereby cause the arm portion to pivot inward and move the stopper downward into the opened position, and being positioned for the second contact surface to engage the first contact surface in response to outward movement of the actuating member and thereby cause the arm portion to pivot outward and move the stopper upward into the closed position.

2. The drinking vessel and lid assembly of claim 1, further comprising:

a stopper biasing member engaged with the stopper and configured to bias the stopper into the closed position in response to outward movement of the actuating member.

3. The drinking vessel and lid assembly of claim 2, wherein the stopper biasing member comprises a spring.

4. The drinking vessel and lid assembly of claim 1, wherein the actuating member comprises a button made from a flexible material operative to bias the actuating member toward a radially outward position.

5. The drinking vessel and lid assembly of claim 1, further comprising:

a stopper biasing member coupled to the stopper and configured to bias the stopper upward into the closed position in response to outward movement of the actuating member, and wherein the actuating member includes a finger engageable portion and a seal portion formed from a flexible material and configured to provide a fluid tight seal between the actuating member an the drinking vessel and permit outward movement of the finger engageable portion and allow the stopper biasing member to move the stopper upward into the closed position when force is removed from the actuating member.

6. The drinking vessel and lid assembly of claim 1, wherein the body of the lid includes a lower portion having threads disposed thereon configured for threaded engagement with the drinking vessel for coupling the body to the drinking vessel.

7. The drinking vessel and lid assembly of claim 1, wherein the body of the lid includes a lower portion a having a coupling portion configured for selective engagement with the drinking vessel.

8. The drinking vessel and lid assembly of claim 1, wherein the actuating member includes a button disposed in the sidewall opening of the drinking vessel.

9. The drinking vessel and lid assembly of claim 1, further comprising a finger loop pivotably coupled to the lid.

10. The drinking vessel and lid assembly of claim 1, further comprising:

a stopper biasing member coupled to the stopper and configured to bias the stopper into the closed position in response to outward movement of the actuating member; and a stopper biasing member housing fixedly coupled to a lower portion of the body of the lid extending downward into the drinking vessel when the lid is coupled to the drinking vessel, the stopper biasing member housing being operative to engage the stopper biasing member when the actuating member moves inward.

11. The drinking vessel and lid assembly of claim 1, wherein one of the first and second contact surfaces has a concave shape and the other of the first and second contact surfaces has a convex shape.

12. The drinking vessel and lid assembly of claim 1, wherein the first contact surface and the second contact surface are spaced apart from each other when an inward force is removed from the actuating member so that the lid is selectively rotatable relative to the drinking vessel without the first contact surface and the second contact surface contacting each other.

13. The drinking vessel and lid assembly of claim 1, wherein the actuating member is selectively removable from the drinking vessel.

14. The drinking vessel and lid assembly of claim 1, wherein the sidewall opening is disposed on a front surface of the sidewall portion at a position such that, when the drinking vessel is gripped by a user for drinking from the drinking opening, the user's thumb will be positioned over the actuating member.

15. The drinking vessel and lid assembly of claim 1, wherein the drinking opening of the lid and the actuating member of the drinking vessel are substantially vertically aligned with each other when the lid is coupled to the drinking vessel.

16. A drinking vessel and lid assembly, comprising:

a drinking vessel comprising a sidewall portion having an opening therein;

an actuating member extending into the sidewall opening and being movably coupled to the drinking vessel; and a lid comprising:

a body selectively couplable to the drinking vessel, the body including an upper portion having a drinking opening configured to permit fluid passage therethrough when the lid is coupled to the drinking vessel; and a stopper coupled to the body and configured for upward displacement into a closed position wherein the stopper engages a portion of the body and sealingly covers the drinking opening to prevent fluid passage therethrough, and downward displacement into an opened position wherein the stopper is spaced apart from the portion of the body to allow fluid passage through the drinking opening, the stopper having an actuating member contact portion that is positioned inside the drinking vessel when the lid is coupled to the drinking vessel;

the actuating member and the actuating member contact portion of the stopper being positioned for the actuating member to engage the actuating member contact portion in response to inward movement of the actuating member and thereby cause the stopper to move downward into the opened position, and being positioned for the actuating member contact portion to engage the actuating member in response to outward movement of the actuating member and thereby cause the stopper to move upward into the closed position.

17. The drinking vessel and lid assembly of claim 16, wherein the actuating member is biased toward an outward position and the stopper is biased toward the closed position.

18. The drinking vessel and lid assembly of claim 16, wherein the actuating member contact portion of the stopper is spaced apart from the actuating member when the actuating member is in an outward position.

19. A drinking vessel and lid assembly, comprising:

a drinking vessel having a sidewall portion having an actuating member extending therethrough and being movably coupled to the drinking vessel, the actuating member being movable inward and outward and comprising a first contact surface positioned inside the drinking vessel; and a lid comprising:

a body having a drinking opening; and a stopper pivotably coupled to the body and configured for displacement between a closed position wherein the stopper engages a portion of the body and covers the drinking opening to prevent fluid passage therethrough, and an opened position wherein the stopper is spaced apart from the portion of the body to allow fluid passage through the drinking opening, the stopper having actuating member contact portion;

the actuating member and the actuating member contact portion of the stopper being positioned for the actuating member to engage the actuating member contact portion in response to inward movement of the actuating member and thereby cause the stopper to move into the opened position, and the actuating member being positioned upon outward movement thereof to permit the stopper to move into the closed position.

20. The drinking vessel and lid assembly of claim 19, wherein the stopper is biased toward the closed position.

21. A drinking vessel and lid assembly, comprising:

a drinking vessel comprising a sidewall portion having a sidewall opening therein;

an actuating member extending into the sidewall opening and being movably coupled to the drinking vessel, the actuating member being movable inward and outward and comprising a first contact surface positioned inside the drinking vessel; and a lid comprising:

a body selectively couplable to the drinking vessel, the body including an upper portion having a drinking opening configured to selectively permit fluid passage therethrough when the lid is coupled to the drinking vessel;

an arm portion pivotably coupled to the body below the drinking opening and having a second contact surface that is positioned inside the drinking vessel and is substantially adjacent to the first contact surface of the actuating member when the lid is coupled to the drinking vessel;

a stopper pivotably coupled to an upper portion of the arm portion and configured for upward displacement into a closed position wherein the stopper engages a portion of the body and covers the drinking opening to prevent fluid passage therethrough, and downward displacement into an opened position wherein the stopper is spaced apart from the portion of the body to allow fluid passage through the drinking opening, the first contact surface of the actuating member and the second contact surface of the stopper being positioned for the first contact surface to engage the second contact surface in response to radially inward movement of the actuating member and thereby cause the arm portion to pivot inward and move the stopper downward into the opened position, and being positioned for the second contact surface to engage the first contact surface in response to radially outward movement of the actuating member and thereby cause the arm portion to pivot outward and move the stopper upward into the closed position.

22. The drinking vessel and lid assembly of claim 21, wherein the stopper is pivotably coupled to the upper portion of the arm portion via a ball joint.

23. The drinking vessel and lid assembly of claim 21, wherein the arm portion is pivotably coupled to a downwardly extending portion of the body.

24. The drinking vessel and lid assembly of claim 21, wherein the body further comprises a biasing member housing extending downward from a bottom surface of the body, the arm portion being pivotably coupled to the biasing member housing, the drinking vessel and lid assembly further comprising:

a biasing member disposed within the biasing member housing and configured to engage with the arm portion and the biasing member housing to bias the arm portion toward an outward position.

25. The drinking vessel and lid assembly of claim 21, wherein the body further comprises a biasing member housing extending downward from a bottom surface of the body including two spaced-apart apertures, and the arm portion comprises a wishbone shaped member having two spaced-apart forked members that each include inward facing protrusions shaped to be received within one of the apertures to permit pivotal attachment of the arm portion to the biasing member housing.

26. The drinking vessel and lid assembly of claim 21, wherein the actuating member comprises an elastic portion that elastically deforms when an inward force is applied to the actuating member and returns to its original shape when the inward force is removed from the actuating member.

* * * * *